US010082052B2

(12) United States Patent
Hattiangadi et al.

(10) Patent No.: US 10,082,052 B2
(45) Date of Patent: Sep. 25, 2018

(54) HYDRAULIC LASH ADJUSTER

(71) Applicant: Caterpillar Inc., Peoria, IL (US)

(72) Inventors: Ashwin A. Hattiangadi, Edwards, IL (US); Selvakumar Selvaraj, Chennai (IN)

(73) Assignee: Caterpillar Inc., Deerfield, IL (US)

( * ) Notice: Subject to any disclaimer, the term of this patent is extended or adjusted under 35 U.S.C. 154(b) by 60 days.

(21) Appl. No.: 15/427,865

(22) Filed: Feb. 8, 2017

(65) Prior Publication Data

US 2018/0223701 A1 Aug. 9, 2018

(51) Int. Cl.
*F01L 1/18* (2006.01)
*F01L 1/24* (2006.01)

(52) U.S. Cl.
CPC ..... *F01L 1/2411* (2013.01); *F01L 1/18* (2013.01); *F01L 2103/00* (2013.01)

(58) Field of Classification Search
CPC ..... F01L 1/18; F01L 1/2411; F01L 2103/00
USPC ..... 123/90.12, 90.39, 90.43, 90.44
See application file for complete search history.

(56) References Cited

U.S. PATENT DOCUMENTS 3,147,745 A 9/1964 Kilgore
6,325,034 B1 12/2001 Edelmayer
8,578,901 B2 * 11/2013 Ruggiero ..... F01L 1/08 123/90.12

FOREIGN PATENT DOCUMENTS

DE 102006007121 A1 8/2007
WO 2016086067 A1 6/2016

* cited by examiner

*Primary Examiner* — Ching Chang
(74) *Attorney, Agent, or Firm* — Miller, Matthias & Hull

(57) ABSTRACT

A replaceable hydraulic lash adjuster and method for assembling such are disclosed. The replaceable hydraulic lash adjuster includes a body, a piston, a check valve and a spring. The body configured to be received in and released from a compartment of a rocker arm. The body including a sidewall surrounding a floor. The floor including a passage that extends between an upper cavity and a lower cavity of the body. The piston disposed in the lower cavity. The piston defining a pocket. A check valve is disposed inside the lower cavity and a spring is disposed inside the pocket. The replacable hydraulic lash adjuster is configured to be slidingly removeable from the rocker arm.

20 Claims, 6 Drawing Sheets

HYDRAULIC LASH ADJUSTER

TECHNICAL FIELD

The present disclosure generally relates to hydraulic lash adjusters and, more particularly, relates to hydraulic lash adjusters used in engine valve actuator assemblies.

BACKGROUND

Each cylinder of an engine, for example a diesel engine, is equipped with one or more valves (e.g., intake and exhaust valves) that are cyclically opened during normal operation. The valves may be opened by way of an actuator assembly that includes a driving member, such as a camshaft, and a rocker arm. The camshaft includes one or more lobes arranged at particular angles corresponding to desired lift timings and amounts of the associated valves. The lobes are connected to stem ends of the associated valves by way of the rocker arm and associated linkage components. As the camshaft rotates, a lobe comes into contact with a first end of the rocker arm causing the rocker arm to pivot, thereby forcing a second end of the rocker arm against the stem end of a valve (via the linkage). This pivoting motion causes the valve to lift or open against a spring bias. As the lobe rotates away from the rocker arm, the valve is released and allowed to return to a closed position.

When a cylinder is equipped with more than one of the same type of valve (e.g., more than one intake valve and/or more than one exhaust valve), valves of the same type may be typically opened at about the same time. To reduce the number of camshafts, lobes, and/or rocker arms required to open multiple valves, a valve bridge, or the like, may be used to interconnect a plurality of valves with a common rocker arm.

For example, an exemplary valve bridge may be generally T-shaped, having arms that extend between the stem ends of two valves. The second end of the rocker arm may engage a portion of the valve bridge, between the bridge arms. With this configuration, the force imparted to the bridge by the pivoted rocker arm results in lifting of the paired valves off of their respective valve seats. A lash adjuster may be associated with the valve bridge and used to remove clearance that may exists between the valves and corresponding seats (and/or between other valve train components) during rocker arm cycle.

Publication WO2016/086067 ("McCarthy et al.") published Jun. 2, 2016, describes an internal combustion engine that has a valvetrain that includes a rocker arm assembly on which is mounted an electronic device and at least part of a generator. A hydraulic lash adjuster is disclosed in McCarthy et al. to provide lash adjustment via relative movement of an inner sleeve and a middle sleeve. While beneficial, the disclosure does not address a replaceable hydraulic lash adjuster that can be slidably installed/removed from inside a compartment of a rocker arm by sliding the hydraulic lash adjuster in or out of the compartment in the rocker arm. As used herein, the terms "slidably" and "slidingly" each mean "able to be moved by sliding."

SUMMARY OF THE DISCLOSURE

In accordance with one aspect of the disclosure, a replaceable hydraulic lash adjuster for an actuator assembly for an engine valve is disclosed. The actuator assembly includes a rocker arm operatively connected to a valve stem of the engine valve. The rocker arm defines a compartment. The replaceable hydraulic lash adjuster comprises a body, a piston, a check valve and a spring. The body is configured to be slidably received in and released from the compartment of the rocker arm. The body has a top end and a bottom end. The top end of the body is configured to be disposed inside the rocker arm. The bottom end of the body may be configured to be disposed outside of the rocker arm. The body includes a sidewall surrounding a floor. The floor is disposed below the top end of the body. The sidewall and the floor define an upper cavity and a lower cavity. The floor includes a passage that extends between the upper cavity and the lower cavity. The lower cavity is configured to receive the piston. The floor may be configured to receive a boss that extends through the rocker arm into the upper cavity. The compartment and the upper cavity form an upper chamber when the body is positioned inside the compartment. The piston includes a plunger, a neck and a base. The neck is disposed between the base and the plunger. The base is disposed inside the lower cavity of the body. The base defines a pocket. The plunger is disposed below and outside of the bottom end of the body and may be configured to be received by a retention member. The check valve may be disposed inside the lower cavity and adjacent to the passage and to the base of the piston. The spring may be disposed inside the pocket. The replacable hydraulic lash adjuster is configured to be slidingly removeable from the compartment of the rocker.

In accordance with another aspect of the disclosure, a method of assembling a replaceable hydraulic lash adjuster for an actuator assembly for an engine valve is disclosed. The actuator assembly includes a rocker arm operatively connected to a valve stem of the engine valve. The rocker arm defines a compartment. The method may comprise: providing a body, the body configured to be slidably received in and released from the compartment of the rocker arm, the body having a top end and a bottom end, the top end of the body configured to be disposed inside the compartment, the bottom end of the body configured to be disposed outside of the rocker arm, the body including a sidewall surrounding a floor, the floor disposed below the top end of the body, the sidewall and the floor defining an upper cavity and a lower cavity, the floor including a passage that extends between the upper cavity and the lower cavity, the lower cavity configured to receive a piston, the floor configured to receive a boss that extends through the rocker arm into the upper cavity, wherein the upper cavity is configured to form an upper chamber with the compartment when the body is positioned inside the compartment; inserting a check valve inside the lower cavity of the body and adjacent to the passage; providing a piston, the piston including a plunger, a neck and a base, the neck disposed between the base and the plunger, the base defining a pocket; and disposing a spring inside the piston and inserting the piston into the body. The hydraulic lash adjuster disposed between the rocker arm and the engine valve.

In accordance with a further aspect of the disclosure, an actuator assembly for an engine valve is disclosed. The engine valve includes a valve stem. The actuator assembly may comprise a rocker arm, a replaceable hydraulic lash adjuster, a boss and a retention member. The rocker arm includes a first arm end and a second arm end. The first arm end is operatively connected to a cam, or the like. The second arm end defines a compartment configured to receive the hydraulic lash adjuster. The second arm end defines a bore extending from an outer surface of the rocker arm to the compartment. The replaceable hydraulic lash adjuster is disposed between the rocker arm and the valve stem. The replaceable hydraulic lash adjuster includes a body, a piston, a check valve and a spring. The body is configured to be slidably received in and released from the compartment of the rocker arm. The body has a top end and a bottom end. The top end of the body is configured to be disposed inside the rocker arm. The bottom end of the body is configured to be disposed outside of the rocker arm and above a retention member. The body includes a sidewall surrounding a floor. The floor is disposed below the top end of the body. The sidewall and the floor define an upper cavity and a lower cavity. The floor includes a passage that extends between the upper cavity and the lower cavity. The lower cavity is configured to receive the piston. The floor is configured to receive the boss that extends through the rocker arm into the upper cavity. The compartment and the upper cavity form an upper chamber. The piston includes a plunger, a neck and a base. The neck is disposed between the base and the plunger. The base is disposed inside the lower cavity of the body. The base defines a pocket. The plunger is disposed below and outside of the bottom end of the body and may be disposed in a recessed surface of the retention member. The check valve is disposed inside the lower cavity and adjacent to the passage and to the base of the piston. The spring is disposed inside the pocket. The replacable hydraulic lash adjuster is slidingly removable from the compartment of the rocker. The boss has an engagement end and a nut end. The boss extends through the bore of the rocker arm into the upper cavity. The engagement end of the boss is configured to receive the floor and to adjust, in a direction parallel to the sidewall, a position of the replaceable hydraulic lash adjuster inside the compartment. The retention member is disposed between the valve stem and the bottom of the body. The retention member includes a recessed surface configured to receive the plunger of the piston.

DETAILED DESCRIPTION

Figure 1:
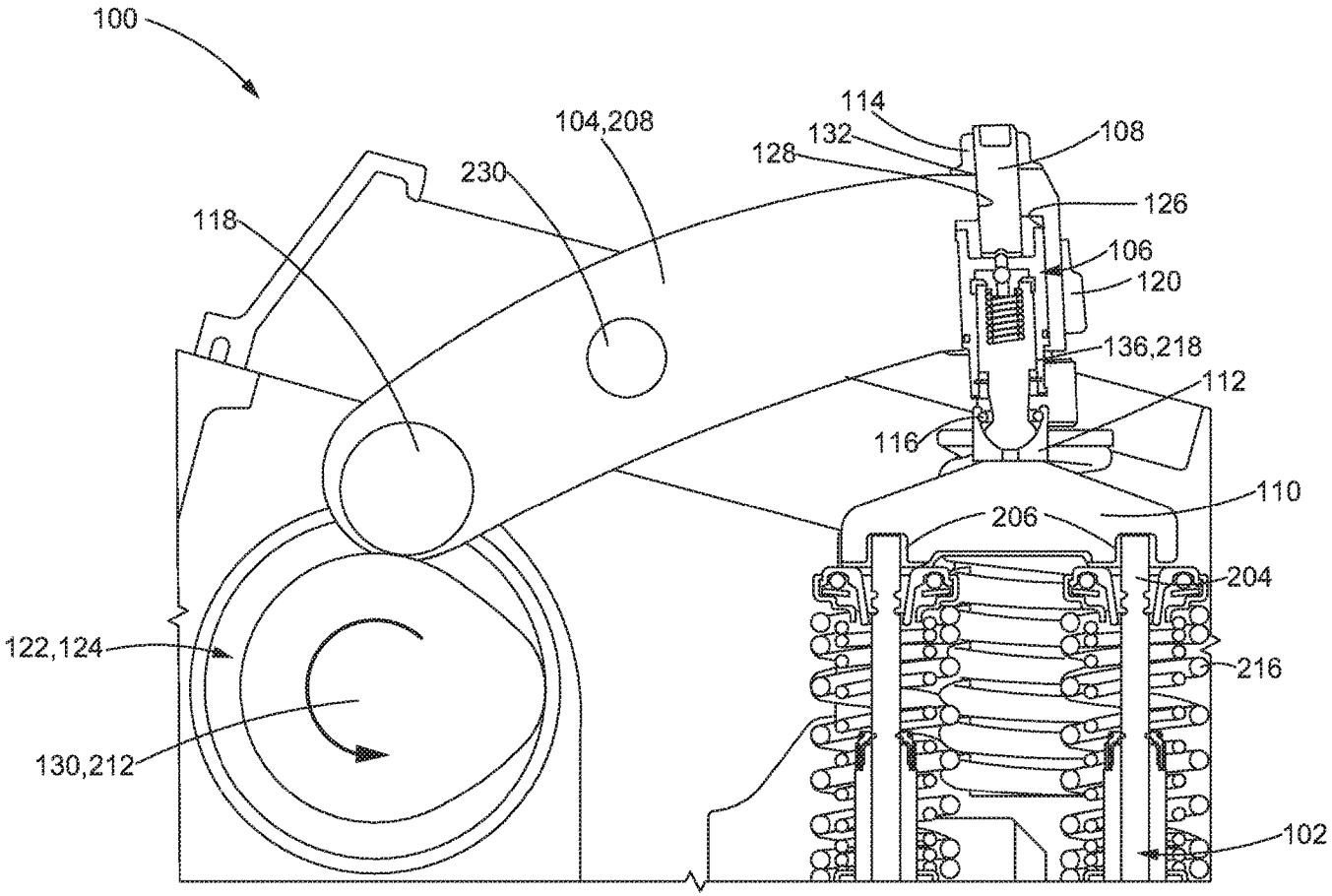
FIG. 1 is a schematic, cross-section of a portion of an exemplary actuator assembly for an engine valve when valve is in a first position, the exemplary actuator assembly including a hydraulic lash adjuster.
Figure 2:
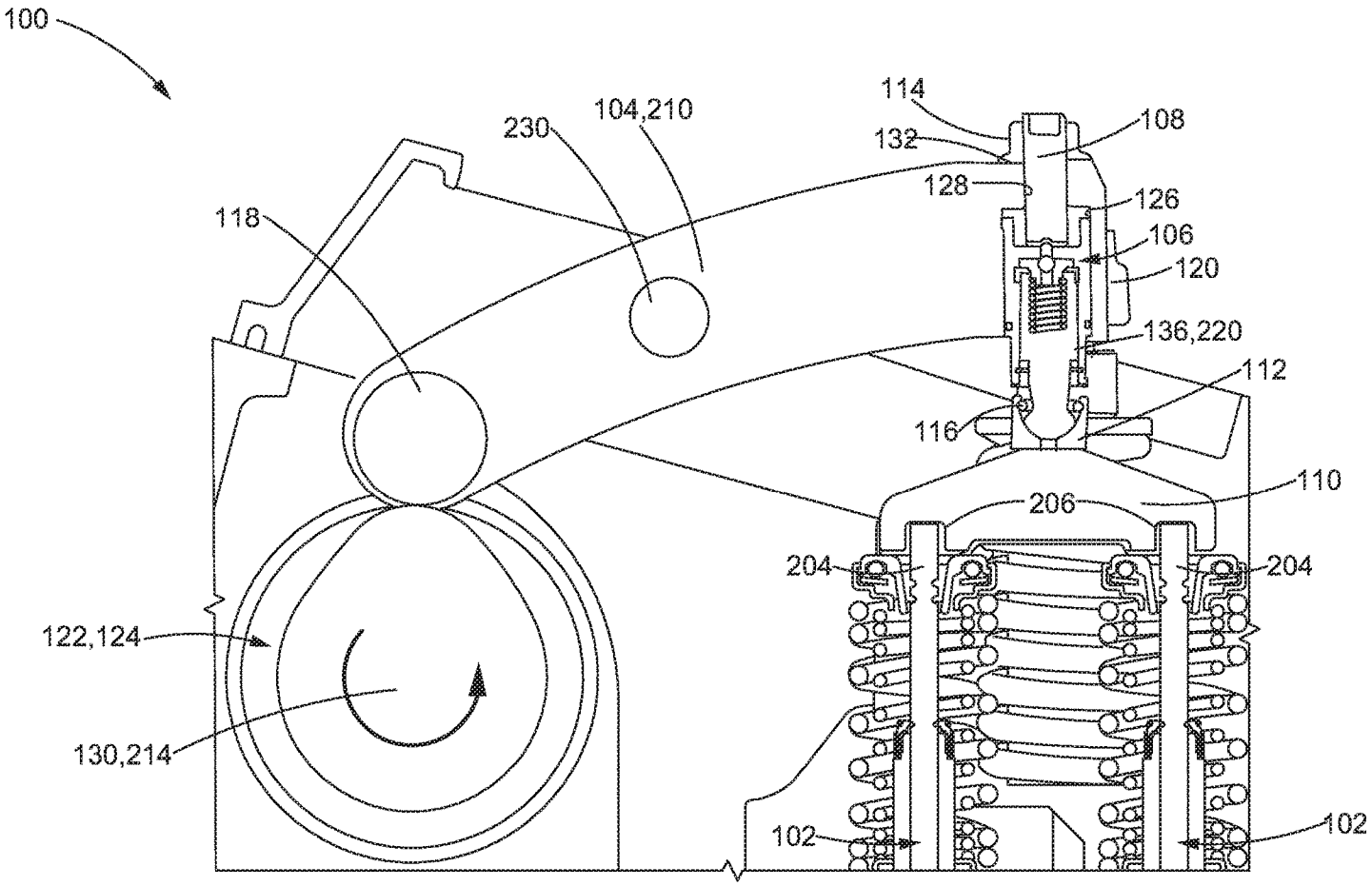
FIG. 2 is a schematic, cross-section of a portion of the exemplary actuator assembly for the engine valve in a second position.

FIGS. 1-2 illustrate an example of actuator assembly 100 (for an engine valve 102) that incorporates the features of the present disclosure. The actuator assembly 100 comprises a rocker arm 104, a replaceable hydraulic lash adjuster (HLA) 106 and a boss 108. The actuator assembly 100 may further comprise a retention member 112 disposed between the rocker arm 104 and one or more valve(s) 102. In some embodiments, the actuator assembly 100 may further comprise a bridge 110. In other embodiments, the bridge 110 may be omitted or may be replaced by one or more other interconnecting members disposed between the rocker arm 104 and one or more valve(s) 102. The actuator assembly 100 may also comprise a nut 114. The actuator assembly 100 may also comprise an retention O-ring 116.

The rocker arm 104 includes a first arm end 118 and a second arm end 120. The first arm end 118 is operatively connected to a driving member 122, such as a cam shaft 124 that includes one or more lobes 130 (a rocker arm 104 activated by the lobe 130 of a cam shaft 124 may be referred to as a cam-activated rocker arm). More specifically, the first arm end 118 may be operatively connected to a lobe 130 of a cam shaft 124. The driving member 122 is configured to actuate the rocker arm 104. The rocker arm 104 defines a compartment 126 and a bore 128, both disposed proximal to the second arm end 120. The compartment 126 is configured to receive the replaceable hydraulic lash adjuster 106. The bore 128 extends from an outer surface 132 of the rocker arm 104 to the compartment 126. In one embodiment, the compartment 126 may be cylindrical in shape.

Figure 3:
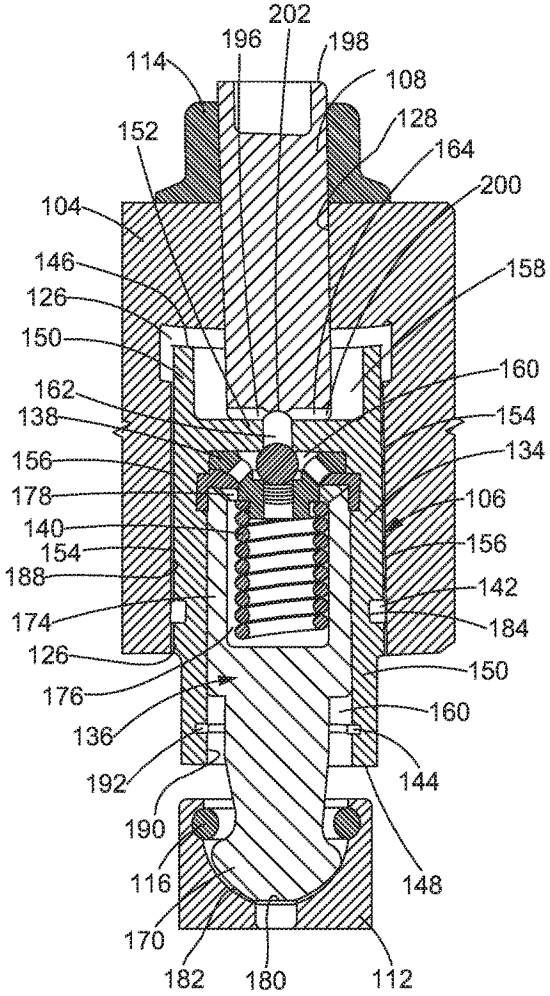
FIG. 3 illustrates an enlarged cross-section of the hydraulic lash adjuster and retention member of FIG. 1.

The replaceable hydraulic lash adjuster 106 is disposed between the rocker arm 104 and one or more valve stems 204 of an engine valve 102. In the exemplary embodiment discussed herein, the replaceable hydraulic lash adjuster 106 is disposed between the rocker arm 104 and the bridge 110, however other embodiments may not include the bridge 110 or may, alternatively, include other interconnecting linkage between the rocker arm 104 and the one or more valve stems 204. As best shown in FIG. 3, the replaceable hydraulic lash adjuster 106 includes a body 134, a piston 136, a check valve 138 and a spring 140. The replaceable hydraulic lash adjuster 106 may further include an adjuster O-ring 142 disposed around the body 134. The replaceable hydraulic lash adjuster 106 may further include a retaining ring 144. The replaceable hydraulic lash adjuster 106 is configured to be slidingly removable from (configured to be slid out of) and slidingly insertable into (configured to be slid into) the compartment 126 of the rocker arm 104.

Figure 4:
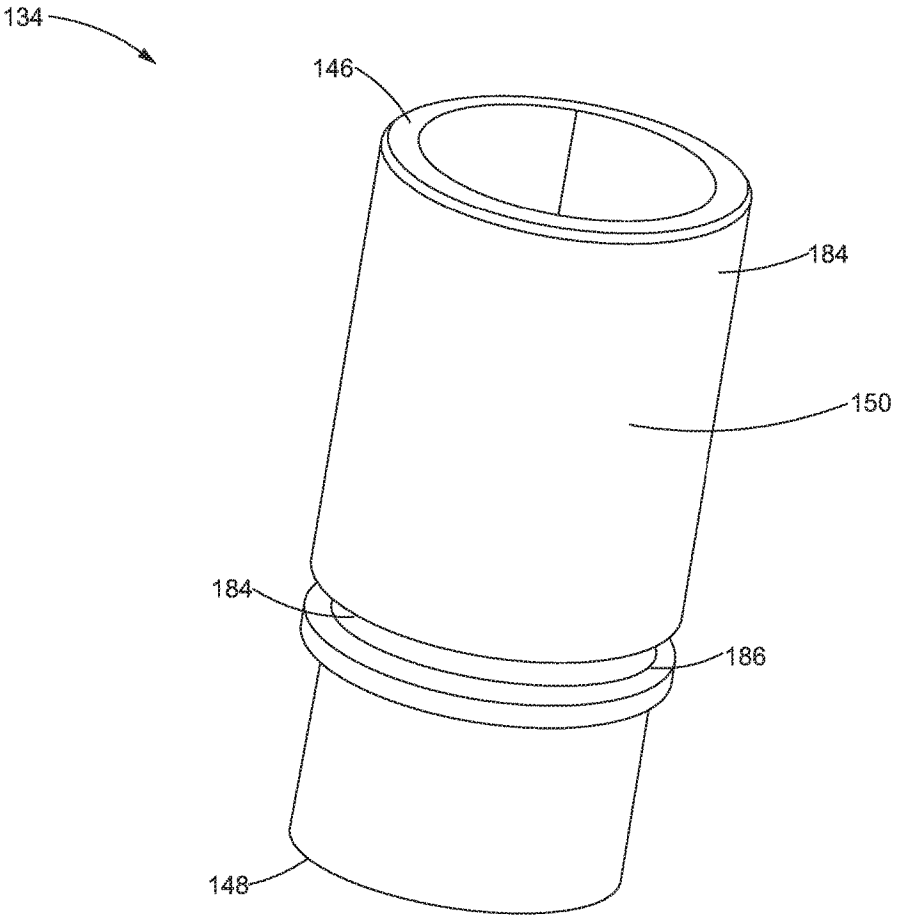
FIG. 4 is a perspective view of a body of the hydraulic lash adjuster of FIG. 4.

The body 134 is configured to be slidably received in and released from the compartment 126 of the rocker arm 104. The body 134 is not configured or dimensioned to be a press-fit into the compartment 126. In one embodiment, such as the one shown in FIG. 4, the body 134 may be cylindrical in shape. The body 134 has a top end 146 and a bottom end 148. The top end 146 of the body 134 is configured to be disposed inside the rocker arm 104 (FIG. 3). The bottom end 148 of the body 134 is configured to be disposed above the retention member 112. The bottom end 148 may be disposed outside of the rocker arm 104. The body 134 includes a sidewall 150 that surrounds a floor 152. The sidewall 150 and the compartment 126 of the rocker define a gap 154 that extends along the length of the sidewall 150 and in a direction parallel to the sidewall 150 and perpendicular to the floor 152. The gap 154 may also extend around the outer perimeter 156 of the sidewall 150.

The floor 152 may be disposed below the top end 146 of the body 134. The floor 152 may be disposed generally perpendicular to the sidewall 150. Herein, with respect to the orientation of the floor 152 in relation to the sidewall 150, generally perpendicular means plus or minus fifteen (15) degrees. The inventors have found that the positioning of the floor 152 between the top end 146 and the bottom end 148 of the body 134 inhibits or eliminates bulging of the sidewall 150 that might occur in some situations due to stress on the sidewall 150.

The sidewall 150 and the floor 152 define an upper cavity 158 and a lower cavity 160. In one embodiment, the upper cavity 158 (as defined by the distance between the top end 146 of the body 134 to the floor 152) is longer than the lower cavity 160 (as defined by the distance between the bottom end 148 to the floor 152). While not wishing to be bound by theory, the relative length of the upper cavity 158 to the lower cavity 160 also contributes to the elimination of deformation of the sidewall 150 due to stress.

The floor 152 includes a passage 162 that extends between the upper cavity 158 and the lower cavity 160. The floor 152 is configured to form with the boss 108 one or more fluid pathways 164 to the check valve 138.

The lower cavity 160 is configured to receive the piston 136. The floor 152 is configured to receive the boss 108 that extends through the rocker arm 104 into the upper cavity 158. The compartment 126 and the upper cavity 158 form an upper chamber 166 when the body 134 is positioned inside the compartment 126. The lower cavity 160 and the piston 136 form a lower chamber 168 when the piston 136 is positioned inside body 134.

Figure 5:
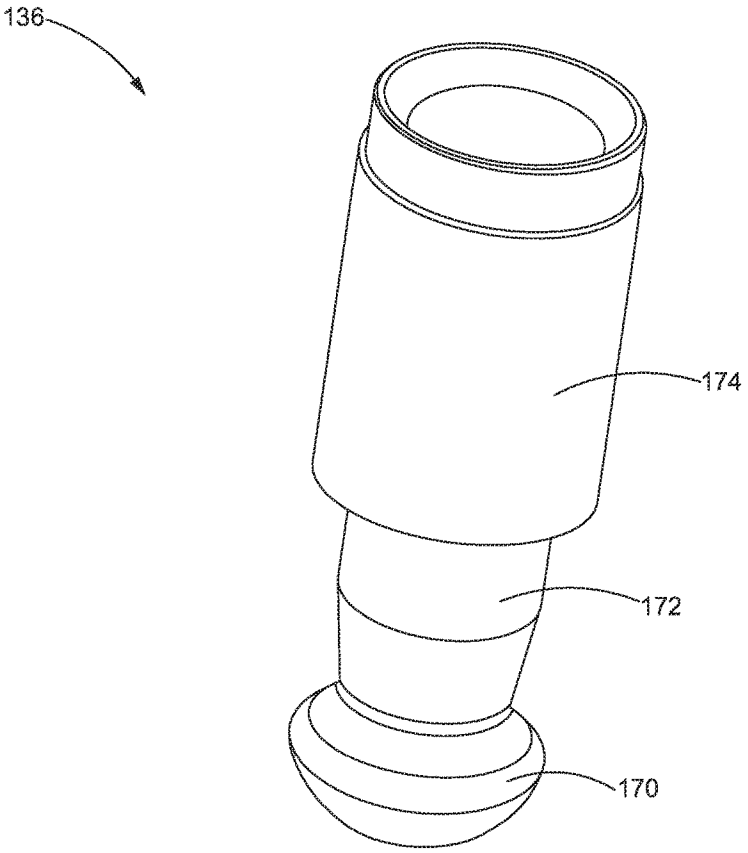
FIG. 5 is a perspective view of a piston of the hydraulic lash adjuster of FIG. 4.

As best shown in FIG. 5, the piston 136 includes a plunger 170, a neck 172 and a base 174. The neck 172 is disposed between the base 174 and the plunger 170. The base 174 is disposed inside the lower cavity 160 (FIG. 3) of the body 134 and defines a pocket 176. The pocket 176 may extend in a direction that is parallel to the sidewall 150. The pocket 176 may include a lip 178. The base 174 is disposed inside the lower cavity 160 of the body 134. The base 174 may be disposed partially outside of the compartment 126. In some embodiments, the base 174 may be disposed entirely inside the lower cavity 160 of the body 134 and partially outside of the compartment 126. The plunger 170 is disposed below and outside of the bottom end 148 of the body 134. The plunger 170 including a contact end 180 that is configured to be received in a recessed surface 182 of the retention member 112. The shape of the contact end 180 substantially reciprocal to the recessed surface 182 of the retention member 112. The piston 136 is slidable (in a direction parallel to the sidewall 150) inside the lower cavity 160 between a primary position 218 (FIG. 1) and a secondary position 220 (FIG. 2).

The check valve 138 is disposed inside the lower cavity 160. The check valve 138 is disposed adjacent to the passage 162 and to the base 174 of the piston 136. The spring 140 is disposed inside the pocket 176.

The adjuster O-ring 142 is disposed around an outside surface 184 (FIG. 4) of the sidewall 150 of the body 134. When the replaceable hydraulic lash adjuster 106 (FIG. 3) is installed inside the compartment 126, the adjuster O-ring 142 may be positioned in the gap 154 between the sidewall 150 of the body 134 and the compartment 126. In some embodiments, the adjuster O-ring 142 may be disposed in a groove 186 (best seen in FIG. 4) in the sidewall 150. The adjuster O-ring 142 may be made of a rubber material, or the like, and may be configured or dimensioned to be pressed against an internal wall 188 (FIG. 4) of the compartment 126 such that the adjuster O-ring 142 provides resistance to sliding movement of the body 134 (in a direction parallel to the sidewall 150). Such resistance, however, is of a relatively small magnitude such that it may be overcome to slidingly move the replaceable hydraulic lash adjuster 106 inside the compartment 126 in a direction parallel to the sidewall 150. For example, the resistance provided by the adjuster O-ring 142 may be overcome by the force imparted by the boss 108 on the floor 152 such that the replaceable hydraulic lash adjuster 106 may be positioned by the boss 108. It may also be overcome so that the replaceable hydraulic lash adjuster 106 may be slidingly installed or removed from the compartment 126.

The retaining ring 144 is disposed below the base 174 of the piston 136 and is mounted to the inner wall 190 of the sidewall 150 inside the lower cavity 160. In some embodiments, the retaining ring 144 may be disposed in a furrow 192 that extends around the inner wall 190 of the sidewall 150 inside the lower cavity 160. The retaining ring 144 may be disposed perpendicular to the sidewall 150. In some embodiments, the retaining ring 144 may be a snap ring or the like.

The boss 108 has an engagement end 196 and a nut end 198. The boss 108 extends through the bore 128 of the rocker arm 104 into the upper cavity 158. The engagement end 196 of the boss 108 is configured to receive the floor 152 and to adjust, in a direction parallel to the sidewall 150, a position of the replaceable hydraulic lash adjuster 106 inside the compartment 126. The boss 108 further a plurality of conduits 200 disposed at the engagement end 196. In one embodiment, the conduits 200 extend radially outward from a center 202 of the boss 108. The floor 152 and the engagement end 196 of the boss 108 form one or more fluid pathways 164 to the passage 162, or more specifically, the floor 152 and each conduit 200 of the boss 108 forms a fluid pathway 164 to the passage 162.

The bridge 110, in the exemplary embodiment of FIGS. 1-2, is operatively connected to the rocker arm 104 and one or more valve stems 204 of an engine valve 102. More specifically, in the exemplary embodiment of FIGS. 1-2, the bridge 110 is operatively connected to the rocker arm 104 via the replaceable hydraulic lash adjuster 106 and the retention member 112. In the exemplary embodiment, the valve stems 204 may each be engaged with bridge bores 206 formed on the bottom of the bridge 110.

The retention member 112 is disposed between the engine valve 102 (valve stems 204) and the bottom of the body 134. In the exemplary embodiment shown in FIGS. 1-2, the retention member 112 is disposed on top of the bridge 110, which is disposed between the retention member 112 and the valve stems 204. In other embodiments, the retention member 112 may be part of the bridge 110 (or other interconnecting linkage). In the exemplary embodiment, the retention member 112 includes a recessed surface 182 (FIG. 3) configured to receive the plunger 170 of the piston 136.

The retention O-ring 116 is disposed on the recessed surface 182 of the retention member 112. More specifically, the retention O-ring 116 is disposed above the plunger 170 of the piston 136 when the piston 136 is disposed against the recessed surface 182 of the retention member 112.

The nut 114 is disposed on the rocker arm 104 and is configured to secure the boss 108 to the rocker arm 104.

INDUSTRIAL APPLICABILITY

Figure 6:
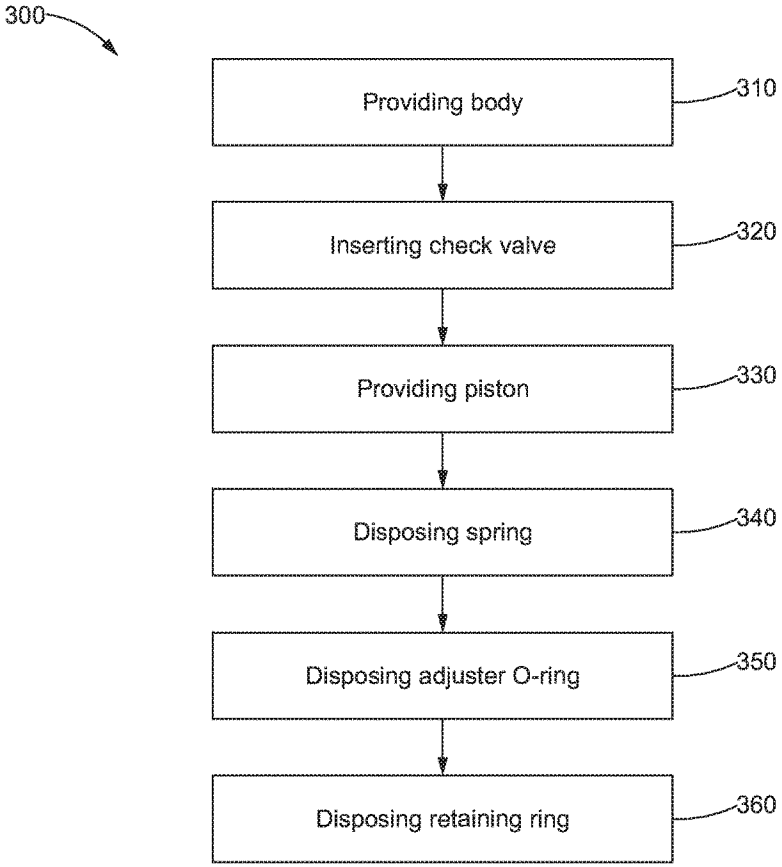
FIG. 6 is an exemplary method of assembling the hydraulic lash adjuster.

FIG. 6 illustrates an exemplary method 300 of assembling a replaceable hydraulic lash adjuster 106. The method 300 may comprise in block 310 providing the body 134 described herein. The method 300 may further comprise, in block 320, inserting the check valve 138 inside the lower cavity 160 of the body 134, and mounting the check valve 138 inside the lower cavity 160 and adjacent to the passage 162. The method 300 may further comprise, in block 330, providing the piston 136. The method 300 may further comprise, in block 340, disposing a spring 140 inside the piston 136 and inserting the piston 136 into the body 134 so that the spring 140 is press fit on to the check valve 138. The method 300 may further comprise, in block 350, disposing the adjuster O-ring 142 around the body 134. The method 300 may further comprise, in block 360, disposing the retaining ring 144 inside the lower cavity 160.

Once assembled the replaceable hydraulic lash adjuster 106 (FIGS. 1-2) may be installed into the rocker arm 104 by sliding the replaceable hydraulic lash adjuster 106 into the compartment 126. In one embodiment, the replaceable hydraulic lash adjuster 106 may be slid into the compartment 126 until the floor 152 contacts the boss 108. The position of the replaceable hydraulic lash adjuster 106 may be slidingly adjusted by adjusting the distance the engagement end 196 of the boss 108 protrudes into the upper cavity 158. To slidingly remove the replaceable hydraulic lash adjuster 106 from the compartment 126, the portion of the body 134 that protrudes from the rocker arm 104 may be gripped and pulled to slide the replaceable hydraulic lash adjuster 106 out of the compartment 126. In embodiments of the replaceable hydraulic lash adjuster 106 that do not include the adjuster O-ring 142, the replaceable hydraulic lash adjuster 106 may freely slide out of the compartment 126 when, during maintenance or repair, the second arm end 120 of the rocker arm 104 is raised up or otherwise moved to make room for the replaceable hydraulic lash adjuster 106 to slide out.

During operation of the engine, the engine valves 102 of the engine (e.g., intake and exhaust valves) are cyclically opened and closed. The engine valves 102 are opened by way of the actuator assembly 100. The driving member 122 moves/pivots the rocker arm 104 (about a shaft 230) from a first position 208 (FIG. 1) to a second position 210 (FIG. 2). In an embodiment, the shaft 230 may be rigidly constrained, for example, the shaft 230 may be bolted or otherwise fixedly mounted to a cylinder head/block.

In the exemplary embodiment shown in FIGS. 1-2, the driving member 122 is a cam shaft 124. The cam shaft 124 includes one or more lobes 130. Each lobe 130 is arranged at a particular angle corresponding to the desired lift timing for the one or more engine valves 102 operably connected to the bridge 110. The operation of the actuator assembly 100 will be explained below from the perspective of one of the exemplary cam shaft 124 lobes 130 and it associated rocker arm 104 shown in FIGS. 1-2.

In FIG. 1, the lobe 130 is shown in an initial position 212 for the cycle. When the lobe 130 of the cam shaft 124 is in the initial position 212, the rocker arm 104 is in the first position 208, and fluid is supplied from a fluid source (not shown) thorough the rocker arm 104 into the upper chamber 166. The check valve 138 is open and the fluid flows through the fluid pathways 164 to the passage 162 and through the passage 162 into the lower chamber 168. The spring 140 disposed in the pocket 176 biases the piston 136 toward the bridge 110 but does not exert enough force on the piston 136 to cause the bridge 110 to lift the engine valve 102 away from its valve seat (not shown).

As the cam shaft 124 rotates, the lobe 130 comes into contact with the first arm end 118 of the rocker arm 104 and the rocker arm 104 begins to pivot about the shaft 230 from the first position 208 of FIG. 1 to the second position 210 of FIG. 2. When this happens, the replaceable hydraulic lash adjuster 106 begins to exert a downward force on the retention member 112 and the top of the bridge 110. The resistance of the bridge 110 provides an upward force on the piston 136 which causes it to slide (in the body 134) upward in the lower chamber 168 toward the floor 152 to a secondary position 220 and to compress the spring 140 disposed in the pocket 176. This movement of the piston 136, reduces the available volume inside the lower chamber 168 and, thus, increases the pressure inside the lower chamber 168. As a result, the pressure in the lower chamber 168 increases above that of the upper chamber 166 and the check valve 138 closes. Fluid no longer flows from the upper chamber 166 to the lower chamber 168 via the passage 162.

As the rocker arm 104 continues to pivot about the shaft 230 to the second position 210, the pivoting motion causes each engine valve 102 operatively connected to the bridge 110 to lift or open against a bias provided by a valve spring 216 positioned around and operatively connected to the valve stem 204 of the engine valve 102. When the lobe 130 of the cam shaft 124 reaches the high-point position 214 the position of the lobe 130 forces the rocker arm 104 fully into the second position 210, the maximum lift of each engine valve 102 from its valve seat occurs.

As the lobe 130 rotates away from the rocker arm 104, the rocker arm 104 begins to pivot about the shaft 230, moving upward and back to the first position 208. The upward movement of the rocker arm 104 reduces the downward force exerted by the piston 136 on the bridge 110. At the same time the reaction force exerted on the piston 136 decreases. Both the combination of the decreasing reaction force exerted on the piston 136 and the bias of the spring 140 in the pocket 176 begin to move the piston 136 toward its primary position 218 at the beginning of the cycle. Movement of the piston 136 toward the primary position 218 increases the volume of the lower chamber 168, thus decreasing the pressure in the lower chamber 168. The check valve 138 opens and fluid begins to flow from the upper chamber 166 through the passage 162 to the lower chamber 168. When the rocker arm 104 reaches the first position 208, the bridge 110 no longer exerts a downward force on the valve stems 204 and the engine valves 102 have return to their closed position in which each engine valve 102 is sealed against its valve seat (not shown). In addition, the piston 136 has returned to its primary position 218 at the beginning of the cycle.

The features disclosed herein may be particularly beneficial to actuator assemblies that include a rocker arm 104 and a hydraulic lash adjuster installed in the compartment 126 of the rocker arm 104. The teachings of the present disclosure provide for a replaceable hydraulic lash adjuster 106 that can be slidably installed into the compartment 126 and slidably removed from the compartment 126, for maintenance or replacement. Conventional hydraulic lash adjusters are typically press-fit into a rocker arm 104. When the hydraulic lash adjuster needs to be replaced, it usually cannot be removed without damaging the rocker arm 104, thus, the rocker arm 104 and the hydraulic lash adjuster must be replaced together.

What is claimed is:

1. A replaceable hydraulic lash adjuster for an actuator assembly for an engine valve, the actuator assembly including a rocker arm operatively connected to a valve stem of the engine valve, the rocker arm defining a compartment, the replaceable hydraulic lash adjuster comprising:

a body configured to be slidably received in and slidably released from the compartment of the rocker arm, the body having a top end and a bottom end, the top end of the body configured to be disposed inside the rocker arm, the bottom end of the body configured to be disposed outside of the rocker arm, the body including a sidewall surrounding a floor, the floor disposed below the top end of the body, the sidewall and the floor defining an upper cavity and a lower cavity, the floor including a passage that extends between the upper cavity and the lower cavity, the lower cavity configured to receive a piston, the floor configured to receive a boss that extends through the rocker arm into the upper cavity, wherein the compartment and the upper cavity form an upper chamber when the body is positioned inside the compartment;

the piston including a plunger, a neck and a base, the neck disposed between the base and the plunger, the base disposed inside the lower cavity of the body, the base defining a pocket, the plunger disposed below and outside of the bottom end of the body and configured to be received by a retention member;

a check valve disposed inside the lower cavity and adjacent to the passage and to the base of the piston; and a spring disposed inside the pocket, wherein the replacable hydraulic lash adjuster is configured to be slidingly removeable from the compartment of the rocker arm.

2. The replaceable hydraulic lash adjuster of claim 1, wherein the floor is further configured to form with the boss a fluid pathway to the check valve.

3. The replaceable hydraulic lash adjuster of claim 1, wherein the rocker arm is cam activated.

4. The replaceable hydraulic lash adjuster of claim 1, wherein the floor is generally perpendicular to the sidewall.

5. The replaceable hydraulic lash adjuster of claim 1, wherein the pocket extends in a direction parallel to the sidewall.

6. The replaceable hydraulic lash adjuster of claim 5, wherein the base is disposed partially outside of the compartment.

7. The replaceable hydraulic lash adjuster of claim 1 further comprising a retaining ring disposed below the base of the piston and mounted to the sidewall inside the lower cavity.

8. The replaceable hydraulic lash adjuster of claim 1, wherein the plunger has a contact end configured to be received by a recessed surface of the retention member, a shape of the contact end substantially reciprocal to the recessed surface of the retention member.

9. A method of assembling a replaceable hydraulic lash adjuster for an actuator assembly for an engine valve, the actuator assembly including a rocker arm operatively connected to a valve stem of the engine valve, the rocker arm defining a compartment, the method comprising:

providing a body, the body configured to be slidably received in and released from the compartment of the rocker arm, the body having a top end and a bottom end, the top end of the body configured to be disposed inside the compartment, the bottom end of the body configured to be disposed outside of the rocker arm, the body including a sidewall surrounding a floor, the floor disposed below the top end of the body, the sidewall and the floor defining an upper cavity and a lower cavity, the floor including a passage that extends between the upper cavity and the lower cavity, the lower cavity configured to receive a piston, the floor configured to receive a boss that extends through the rocker arm into the upper cavity, wherein the upper cavity is configured to form an upper chamber with the compartment when the body is positioned inside the compartment;

inserting a check valve inside the lower cavity of the body and adjacent to the passage;

providing a piston, the piston including a plunger, a neck and a base, the neck disposed between the base and the plunger, the base defining a pocket; and disposing a spring inside the piston and inserting the piston into the body, wherein the hydraulic lash adjuster is disposed between the rocker arm and the engine valve.

10. The method of claim 9, further including positioning the piston so that the base is disposed inside the lower cavity of the body and the plunger is disposed outside of the bottom end of the body.

11. The method of claim 9, wherein the floor is generally perpendicular to the sidewall.

12. The method of claim 9, further including disposing an adjuster O-ring around the sidewall.

13. An actuator assembly for an engine valve that includes a valve stem, the actuator assembly comprising:

a rocker arm that includes:

a first arm end operatively connected to a cam shaft; and a second arm end defining a compartment configured to receive a replaceable hydraulic lash adjuster and defining a bore extending from an outer surface of the rocker arm to the compartment;

the replaceable hydraulic lash adjuster disposed between the rocker arm and the valve stem, the replaceable hydraulic lash adjuster including:

a body configured to be slidably received in and released from the compartment of the rocker arm, the body having a top end and a bottom end, the top end of the body configured to be disposed inside the rocker arm, the bottom end of the body configured to be disposed outside of the rocker arm and above a retention member, the body including a sidewall surrounding a floor, the floor disposed below the top end of the body, the sidewall and the floor defining an upper cavity and a lower cavity, the floor including a passage that extends between the upper cavity and the lower cavity, the lower cavity configured to receive a piston, the floor configured to receive a boss that extends through the rocker arm into the upper cavity, wherein the compartment and the upper cavity form an upper chamber;

the piston including a plunger, a neck and a base, the neck disposed between the base and the plunger, the base disposed inside the lower cavity of the body, the base defining a pocket, the plunger disposed below and outside of the bottom end of the body and in a recessed surface of the retention member;

a check valve disposed inside the lower cavity and adjacent to the passage and to the base of the piston; and a spring disposed inside the pocket, wherein the replacable hydraulic lash adjuster is slidingly removable from the compartment of the rocker;

the boss having an engagement end and a nut end, the boss extending through the bore of the rocker arm into the upper cavity, the engagement end of the boss configured to receive the floor and to adjust, in a direction parallel to the sidewall, a position of the replaceable hydraulic lash adjuster inside the compartment; and the retention member disposed between the valve stem and the bottom of the body, the retention member including a recessed surface configured to receive the plunger of the piston.

14. The actuator assembly of claim 13, further comprising a bridge disposed between the retention member and the valve stem of the engine valve.

15. The actuator assembly of claim 13, in which the boss further a plurality of conduits disposed at the engagement end.

16. The actuator assembly of claim 15, wherein the floor and each conduit forms a fluid pathway to the passage.

17. The actuator assembly of claim 13, further including a nut configured to secure the boss to the rocker arm.

18. The actuator assembly of claim 13, wherein the sidewall and the compartment define a gap that extends along a length of the sidewall and in a direction parallel to the sidewall.

19. The actuator assembly of claim 13, the hydraulic lash adjuster further including an adjuster O-ring disposed around the body.

20. The actuator assembly of claim 13, wherein the upper cavity is longer than the lower cavity.

* * * * *